US005261435A

United States Patent [19]

Stanley et al.

[11] Patent Number: 5,261,435

[45] Date of Patent: Nov. 16, 1993

[54] SHADING DEVICE

[76] Inventors: Robert W. Stanley; Russell A. Stanley, both of 3018 Clinton St., both of Gulfport, Fla. 33707

[21] Appl. No.: 929,425

[22] Filed: Aug. 14, 1992

[51] Int. Cl.[5] ..... E04H 15/04

[52] U.S. Cl. ..... 135/90; 135/91; 135/94; 135/98

[58] Field of Search ..... 135/90, 91, 94, 101, 135/105, 114, 117, 98, 20.1, 21, 115, 119; 403/378

[56] References Cited

U.S. PATENT DOCUMENTS

| | | | |
|---|---|---|---|
| 757,175 | 4/1904 | Burland | 135/90 |
| 1,571,295 | 2/1926 | Newman | 135/114 |
| 2,255,837 | 9/1941 | Volk | 135/90 |
| 2,952,024 | 9/1960 | Bartolucci | 135/115 |
| 3,353,547 | 11/1967 | Albright | 135/94 |
| 3,805,816 | 4/1974 | Nolte | 135/1 R |
| 4,637,416 | 1/1987 | McFarlin | 135/109 |

*Primary Examiner*—Carl D. Friedman
*Assistant Examiner*—Matthew E. Leno
*Attorney, Agent, or Firm*—Michael I. Kroll

[57] ABSTRACT

A shading device is provided which consists of a roof-like structure and a mechanism for supporting the roof-like structure above the ground, so that the rooflike structure will serve as a shelter, especially for the interception of rays from the sun to diminish light intensity.

2 Claims, 2 Drawing Sheets

SHADING DEVICE

BACKGROUND OF THE INVENTION

1. Field of the Invention

The instant invention relates generally to carports and more specifically it relates to a shading device.

2. Description of the Prior Art

Numerous carports have been provided in prior art that are adapted to shelter automobiles which are generally permanent roofs projecting from the sides of buildings. While these units may be suitable for the particular purpose to which they address, they would not be as suitable for the purposes of the present invention as heretofore described.

SUMMARY OF THE INVENTION

A primary object of the present invention is to provide a shading device that will overcome the shortcomings of the prior art devices.

Another object is to provide a shading device that is a portable non-permanent lightweight strong structure which can be moved from one place to the next with a minimum of effort, so as to serve as a shelter from the rays of the sun.

An additional object is to provide a shading device that can include an enclosure assembly which offers additional protection to any article or person therein from dust, snow, hail, rain and the like.

A further object is to provide a shading device that is simple and easy to use.

A still further object is to provide a shading device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
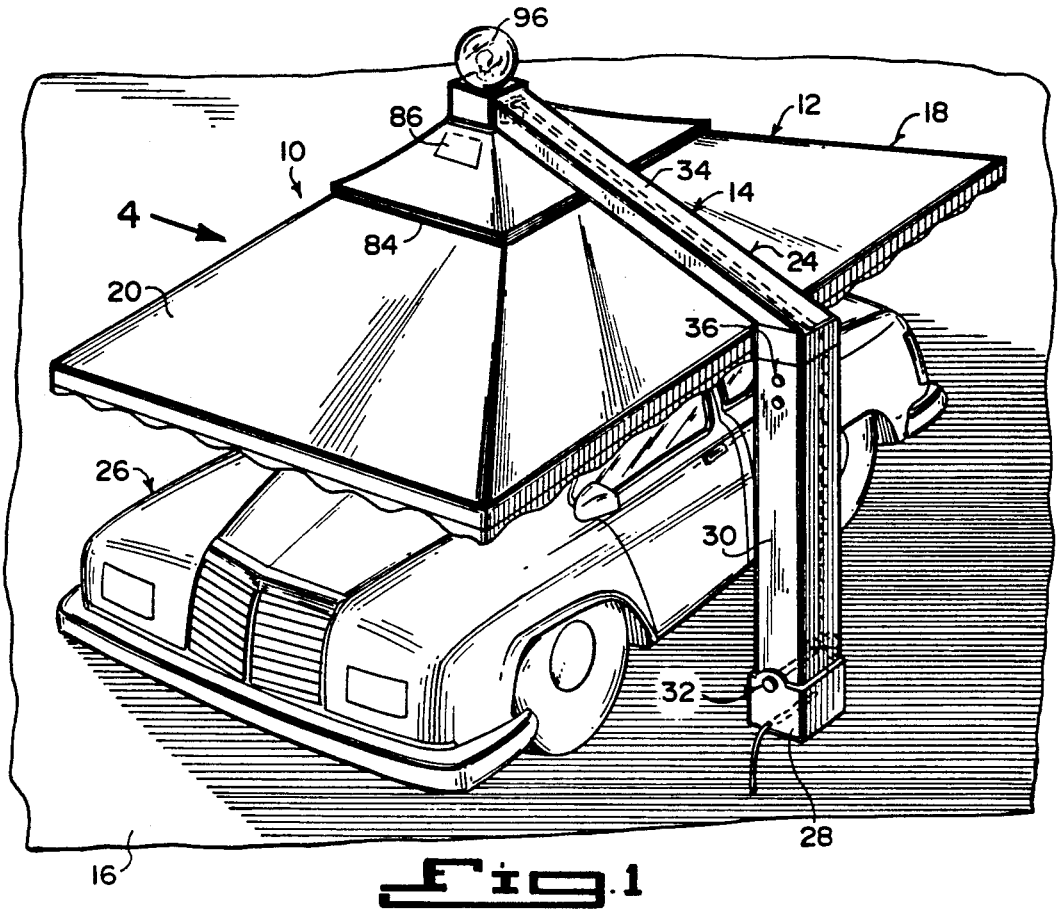
FIG. 1 is a perspective view of the instant invention protecting a motor vehicle.
Figure 2:
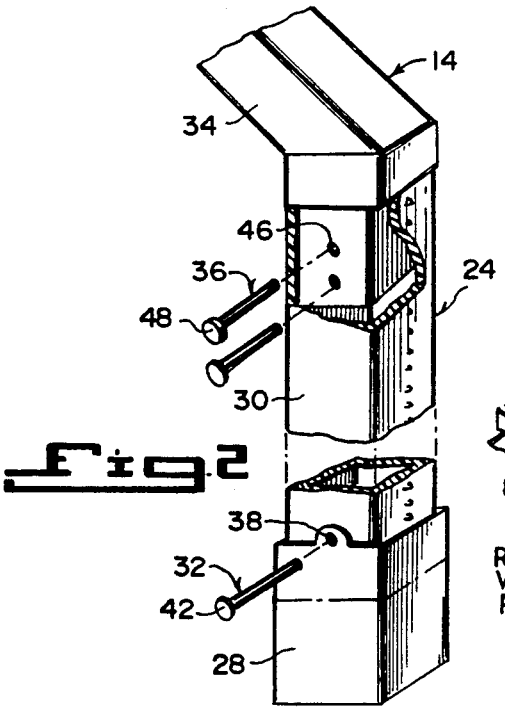
FIG. 2 is a perspective view with parts broken away and in section showing how the anchor pins are inserted within the supporting structure.
Figure 3:
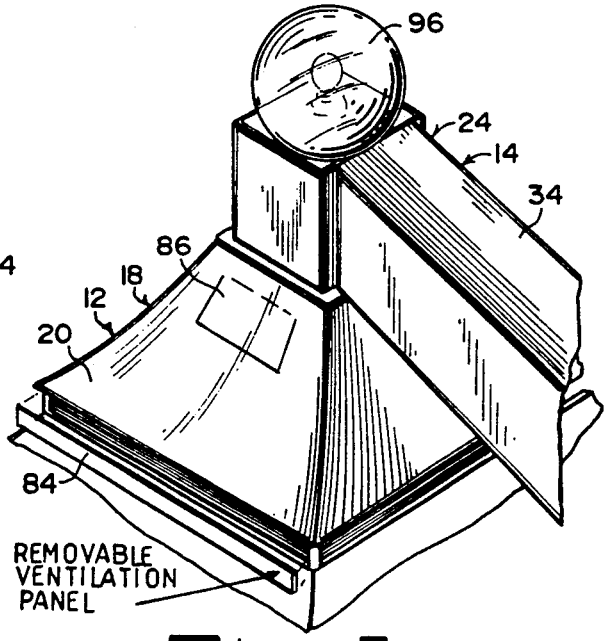
FIG. 3 is a perspective view with parts broken away of the canopy and suspension arm.
Figure 4:
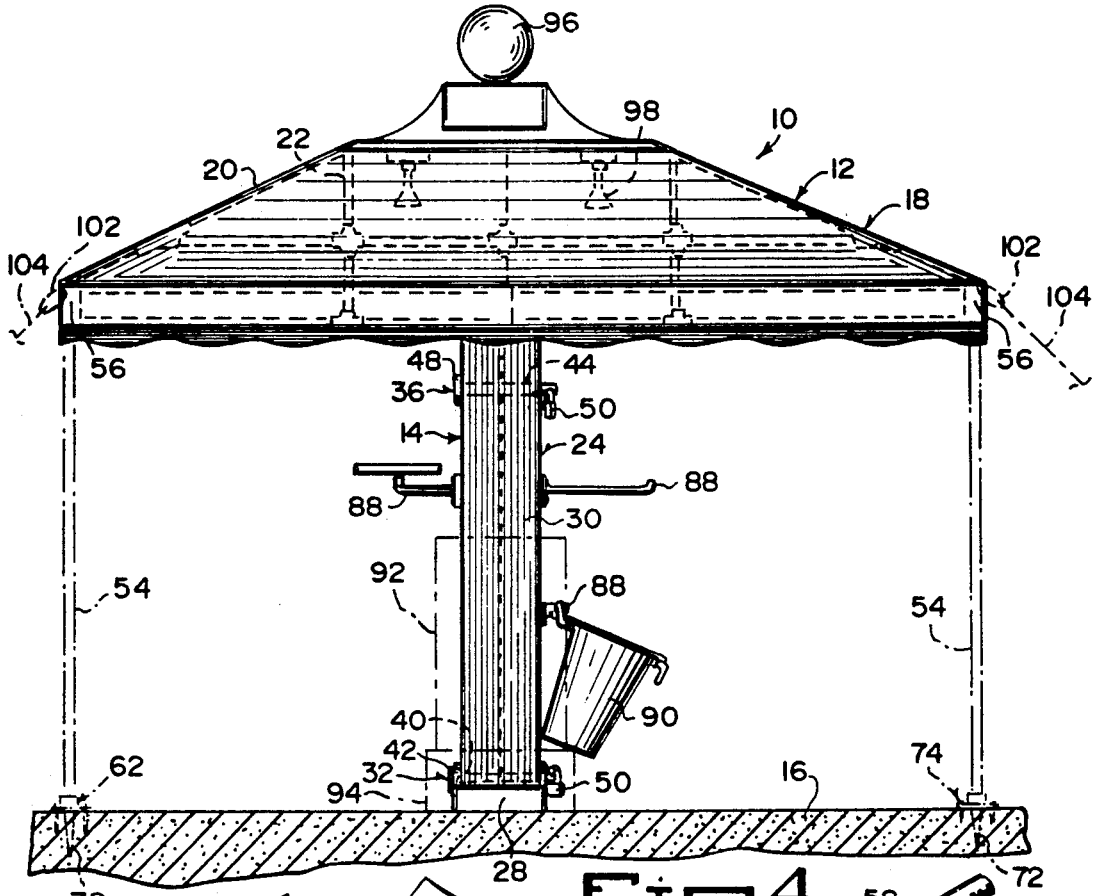
FIG. 4 is an elevational view taken in direction of arrow 4 in FIG. 1.
Figure 5:
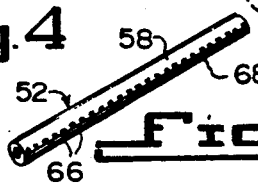
FIG. 5 is a perspective view of the enclosure assembly rolled up.
Figure 8:
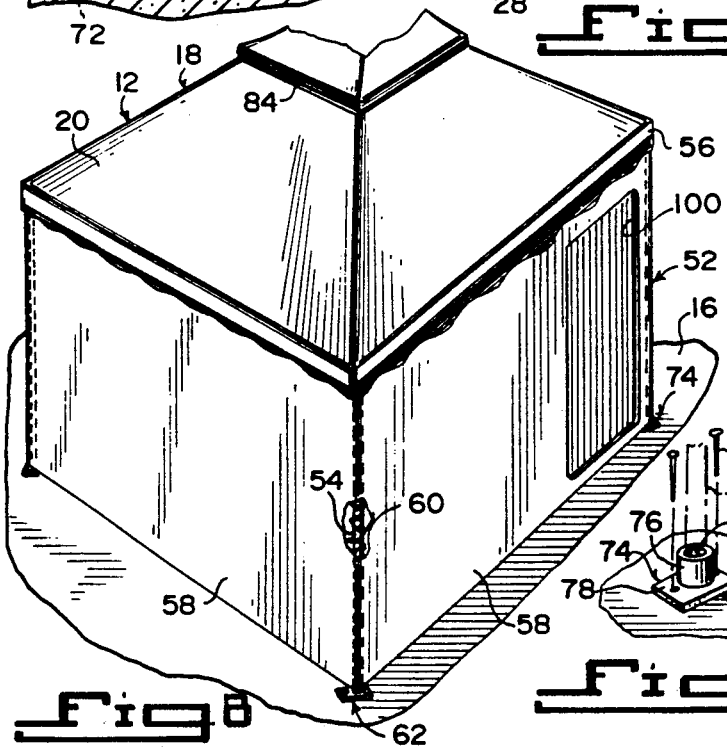
FIG. 8 is a perspective view with parts broken away showing the enclosure assembly secured and extending between the canopy and the ground.
Figure 7:
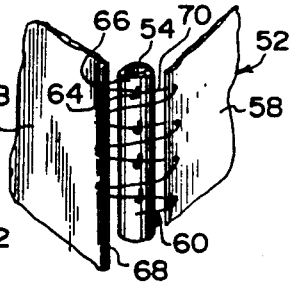
FIG. 7 is an enlarged perspective view with parts broken away showing how two panels are secured to one of the support poles of the enclosure assembly.
Figure 6:
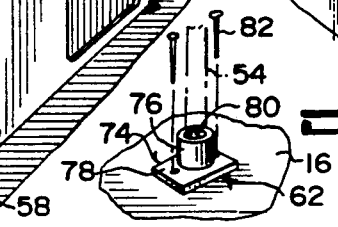
FIG. 6 is an enlarged perspective view showing how one mounting foot is installed in the ground.

Turning now descriptively to the drawings, in which similar reference characters denote similar elements throughout the several views, the Figures illustrate a shading device 10 which consists of a rooflike structure 12 and a mechanism 14 for supporting the rooflike structure 12 above the ground 16. The rooflike structure 12 will serve as a shelter, especially for the interception of rays from the sun to diminish light intensity.

The rooflike structure 12 is a canopy 18 that includes an outer shell 20 having a frustum pyramidal shape and an inner frame 22 for holding the outer shell 20 in its frustum pyramidal shape. The supporting mechanism 14 is a stanchion 24 to overhang the canopy 18, so that the stanchion 24 will not interfere with any article 26, such as a motor vehicle and person placed under the canopy 18.

The stanchion 24 consists of a base member 28 having a lower portion extending into the ground 16, an upright column 30 and an apparatus 32 for temporarily mounting a bottom portion of the upright column 30 to an upper portion of the base member 28. A suspension arm 34 is also provided, with an apparatus 36 for temporarily mounting a top portion of the upright column 30 to a lower portion of the suspension arm 34. The suspension arm 34 can extend angularly therefrom, with an upper portion of the suspension arm 34 to overhang the canopy 18 from the upright column 30.

The first temporary mounting apparatus 32 contains the upper portion f the base member 28 having a transverse aperture 38 therethrough. The bottom portion of the upright column 30 has a transverse aperture 40 therethrough and is sized to fit into the upper portion of the base member 28. The transverse aperture 38 in the base member 28 will be aligned with the transverse aperture 40 in the upright column 30. An anchor pin 42 extends through the transverse aperture 38 in the base member 28 and the transverse aperture 40 in the upright column 30 to temporarily hold the upright column 30 to the base member 28.

The second temporary mounting apparatus 36 contains the top portion of the upright column 30 having a transverse aperture 44 therethrough. The lower portion of the suspension arm 34 having a transverse aperture 46 therethrough and is sized to fit into the top portion of the upright column 30. The transverse aperture 44 in the upright column 30 will be aligned with the transverse aperture 46 in the suspension arm 34. An anchor pin 48 extends through the transverse aperture 44 in the upright column 30 and the transverse aperture 46 in the suspension arm 34 to temporarily hold the suspension arm 34 to the upright column 30.

The shading device 10 further includes a pair of padlocks 50, whereby each padlock 50 is utilized for retaining each anchor pin 42, 48 to prevent an unauthorized disassembly of the shading device 10.

An enclosure assembly 52 can be secured to and extend between the canopy 18 and the ground 16 to offer additional protection to any article 26 and person therein from harsh weather conditions. The enclosure assembly 52 consists of a plurality of support poles, each vertically mounted between a corner 56 of the canopy 18 and the ground 16. A plurality of flexible side wall panels 58 are provided. A mechanism 60 is for securing the panels 58 between the support poles 54. A mechanism 62 is for attaching each lower end of each support pole 54 to the ground 16.

The securing mechanism 60 includes each support pole 54 having a plurality of hooks 64 vertically spaced apart thereon. Each panel 58 has a plurality of holes 66 vertically spaced apart along each side edge 68. A cord 70 is threaded through the holes 66 at the engaging side edges 68 of two panels 58 and around the hooks 64 on one of the support poles 54 therebetween.

The attaching mechanism 62 includes each lower end of each support pole 54 having a pointed tip 72 to be inserted within the ground 16. The attaching mechanism 62 further includes a plurality of mounting feet 74, each having a collar 76 on a plate 78 with a central aperture 80 therethrough to receive the lower end of one support pole 54. Two spikes 82 are inserted through the plate 78 and into the ground 16.

The canopy 18 further contains a removable ventilation panel 84, so that a barbecue and the like can be utilized under the canopy 18. A pressure relief flap 86 is to stabilize the canopy 18 during strong wind gusts.

A plurality of hanger attachments 88 can be affixed to the upright column 30 for holding various items thereto, such as rags, chamois, tools and a trash can 90. An adjustable and removable flexible bumper block 92 can be placed on the upright column 30 to protect a motor vehicle door and the like. A flexible boot 94 can be used to cover the upper portion of the base member 28 to prevent water and dirt from going down into the base member 28 in the ground 16. An external electric lamp 96 is mounted on an upper portion of the suspension arm 34. A plurality of internal electric lamps 98 are mounted onto the inner frame 22 of the canopy 18, so that the shading device 10 can also be utilized in the dark.

One of the panels 58 can also contain a doorway 100, so that a person can enter and leave the enclosure assembly 52. A picnic table and benches (not shown) can also be attached to the upright column 30. A tie down ring 102 can also be placed at each corner 56 of the canopy with a guy rope 104 extending to the ground 16 to better stabilize the shading device 10 during severe weather conditions. Since the shading device 10 is not a permanent structure the requirement of a building permit is eliminated. A provision can also be made in the shading device 10 by changing the shape of the suspension arm 34, so that it can have the ability to couple two or more canopies 18 together to cover a motor vehicle 26, as shown in FIG. 1, as well as boats and other large objects (not shown).

LIST OF REFERENCE NUMBERS 10 shading device
12 rooflike structure
14 supporting mechanism
16 ground
18 canopy
20 outer shell
22 inner frame
24 stanchion for 14
26 article
28 base member
30 upright column
32 first temporary mounting apparatus
34 suspension arm
36 second temporary mounting apparatus
38 transverse aperture in 28
40 transverse aperture in 30
42 anchor
44 transverse aperture in 30
46 transverse aperture in 34
48 anchor pin
50 padlock
52 enclosure assembly
54 support pole
56 corner of 18
58 flexible side wall panel
60 securing mechanism
62 attaching mechanism
64 hook on 54
66 hole in 58
68 side edge on 58
70 cord
72 pointed tip on 54
74 mounting foot
76 collar of 74
78 plate of 74
80 central aperture in 74
82 spike
84 removable ventilation panel
86 pressure relief flap
88 hanger attachment
90 trash can
92 bumper block on 30
94 flexible boot on 28
96 external electric lamp on 34
98 internal electric lamp on 22
100 doorway in 58
102 tie down ring
104 guy rope It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A shading device which comprises:

a) a rooflike structure;

b) means for supporting said rooflike structure above the ground, so that said rooflike structure will serve as a shelter, especially for the interception of rays from the sun to diminish light intensity, said rooflike structure is a canopy, said canopy includes an outer shell having a frustum pyramidal shape, and an inner frame for holding said outer shell in its frustum pyramidal shape, said supporting means is a stanchion to overhang said canopy, so that said stanchion will not interfere with any article and person placed under said canopy, said stanchion includes a base member having a lower portion extending into the ground, an upright column, means for temporarily mounting a bottom portion of said upright column to an upper portion of said base member, a suspension arm, and means for temporarily mounting a top portion of said upright column to a lower portion of said suspension arm, so that said suspension arm can extend angularly therefrom, with an upper portion of said suspension arm to overhang said canopy from said upright column, a first temporary mounting means includes the upper portion of said base member having a transverse aperture therethrough, the bottom portion of said upright column having a transverse aperture therethrough and is sized to fit into the upper portion of said base member, so that said transverse aperture in said base member will be aligned with said transverse aperture in said upright column, and an anchor pin to extend through said transverse aperture in said base member and said transverse aperture in said upright column to temporarily hold said upright column to said base member, a second temporary mounting means includes the top portion of said upright column having a transverse aperture therethrough, the lower portion of said suspension arm having a transverse aperture therethrough and is sized to fit into the top portion of said upright column, so that said transverse aperture in said upright column will be aligned with said transverse aperture in said suspension arm, and an anchor pin to extend through said transverse aperture in said upright column and said transverse aperture in said suspension arm to temporarily hold said suspension arm to said upright column;

c) a pair of padlocks, whereby each said padlock is utilized for retaining each said anchor pin to prevent an unauthorized disassembly of said shading device;

d) an enclosure assembly secured to and extending between said canopy and the ground to offer additional protection to any article and person therein from harsh weather conditions, said enclosure assembly includes a plurality of support poles, each vertically mounted between a corner of said canopy and the ground, a plurality of flexible side wall panels, means for securing said panels between said support poles, and means for attaching each lower end of each said support pole to the ground, said securing means includes each said support pole having a plurality of hooks vertically spaced apart thereon, each said panel having a plurality of holes vertically spaced apart along each side edge, and a plurality of cords which are each threaded through said holes at the engaging side edges of two said panels and around said hooks on one said support pole therebetween, said attaching means includes each lower end of each said support pole having a pointed tip to be inserted within the ground, said attaching means further includes a plurality of mounting feet, each having a collar on a plate with a central aperture therethrough to receive the lower end of one said support pole, and a plurality of spikes in which two are to be inserted through said plate and into the ground, said canopy further includes a removable ventilation panel, so that a barbecue can be utilized under said canopy, and a pressure relief flap to stabilize said canopy during strong wind gusts; and e) a plurality of hanger attachments affixed to said upright column for holding various items thereto, an adjustable and removable flexible bumper block on said upright column to protect a motor vehicle door, and a flexible boot to cover the upper portion of said base member to prevent water and dirt from going down into said base member in the ground.

2. A shading device as recited in claim 1, further including:

a) an external electric lamp mounted on an upper portion of said suspension arm; and b) a plurality of internal electric lamps mounted onto said inner frame of said canopy, so that said shading device can also be utilized in the dark.

* * * * *